United States Patent [19]

Klein et al.

[11] Patent Number: 4,983,279

[45] Date of Patent: Jan. 8, 1991

[54] PROCESS FOR THE HYDROGENATION OF LIQUID CHARGE MATERIALS WHICH CONTAIN CARBON

[75] Inventors: Wolfdieter Klein, Recklinghausen; Claus Strecker, Gelsenkirchen; Alfons Feuchthofen, Recklinghausen; Ulrich Boenisch, Muelheim am Ruhr, all of Fed. Rep. of Germany

[73] Assignee: Veba Oel Aktiengesellschaft, Gelsenkirchen, Fed. Rep. of Germany

[21] Appl. No.: 279,089

[22] Filed: Dec. 2, 1988

[30] Foreign Application Priority Data

Dec. 4, 1987 [DE] Fed. Rep. of Germany ..... 3741105

[51] Int. Cl.[5] ..... C10G 1/06

[52] U.S. Cl. ..... 208/413; 208/419; 208/143

[58] Field of Search ..... 208/413, 419, 143

[56] References Cited

U.S. PATENT DOCUMENTS 4,473,460 9/1984 Kuerten et al. ..... 208/413

4,639,310 1/1987 Dohler et al. ..... 208/413 X

*Primary Examiner*—Curtis R. Davis

*Assistant Examiner*—William C. Diemler

*Attorney, Agent, or Firm*—Oblon, Spivak, McClelland, Maier & Neustadt

[57] ABSTRACT

A process for the hydrogenation of a liquid hydrocarbon-containing charge material, comprising the steps of: (i) supplying a high temperature high pressure liquid phase hydrogenation reactor with two separately and indirectly heated charge streams, (a) a primary charge stream comprising liquid hydrocarbon oils, oil residues, syncrudes, tars or pitches and optionally coal, and hydrogen-containing gas, and (b) a directly heated secondary gaseous charge stream comprising hydrogen-containing gas, and combining said indirectly heated primary charge stream and said indirectly and directly heated secondary charge stream prior to said liquid phase hydrogenation reactor, hydrogenating the combined streams to produce a hydrogenation product and separating the hydrogenation product in a hot separator to give a hot separator head product; wherein said indirectly heated primary and secondary charge streams are heated by separate heat exchange means by heat exchange with said hot separator head product, and said secondary charge stream, after heating by heat exchange, is directly heated with a hydrogenation gas heater.

13 Claims, 1 Drawing Sheet

PROCESS FOR THE HYDROGENATION OF LIQUID CHARGE MATERIALS WHICH CONTAIN CARBON

BACKGROUND OF THE INVENTION

1. Field of the Invention:

The invention relates to a process for the hydrogenation of liquid charge materials which contain carbon, such as heavy oils, oil residues, top or vacuum residues, syncrudes from oil shale, tar sands, tars and pitches from hard coal or brown coal, with gases which contain hydrogen as the hydrogenation gas, under the conditions of liquid phase hydrogenation at elevated temperature and elevated pressure, if necessary in the presence of an additive or even a catalyst, with a subsequent hot separator stage, with separate heating of a charge stream composed of the charge materials and a partial stream of the hydrogenation gas, and of a second partial stream of the hydrogenation gas. The charge materials are liquid either at normal temperature or at elevated temperatures.

2. Discussion of the Background:

The present invention relates to a process in which heavy oil is passed to a pre-heater as the charge product, and a partial stream of the entire hydrogenation gas amount required, which partial stream has been heated in a heat exchanger through which the hot separator head product flows, is added to the preheated mixture of heavy oil, additive, if necessary, and hydrogenation gas, before entry into the liquid phase reactor (cf. DE 35 23 709 Al).

In the known processes of this type, heating of the charge products to the temperature required for entry into the reaction system takes place by means of a heating furnace provided in the charge product stream. This heating furnace is one of the most critical components of any liquid phase hydrogenation system. This is particularly due to the operating conditions, characterized by high hydrogen partial pressure in the pipe, high pipe wall temperatures and high overall pressure, which set limits of operating technology for the material which can be used.

According to "Die Katalytische Druckhydrierung von Kohlen, Teeren und Mineralolen", Springer-Verlag, Berlin/Gottingen/Heidelberg 1950, page 232, heating of the reaction components basically takes place in heat exchangers and in the peak pre-heater. As heat exchangers, "bundle" regenerators are generally used, and for peak pre-heating by means of the externally heated heating furnace, hairpin-shaped pressure pipes with a clear diameter of 90 and 110 mm and a total length of about 30,000 mm are used, with the charge product stream being passed through the pipes and heated by means of circulating gas.

The process conditions, characterized by a multiphase stream of gases and vapors, liquid as well as solid in the pipe, result in significant uncertainties in designing of the heating furnace as well as in calculating the pressure loss and the heat transport.

The use of such peak pre-heaters is subject to disadvantages of process technology which result due to high pressure losses in the pre-heater, poor heat transfer as well as undefined conditions caused by the three-phase system present in the pipe.

Disadvantages in terms of operating technology result from the tendency towards encrustation of the interior of the furnace pipes and coking reactions of the product in the pipes. Further, operating time limitations of the hydrogenation system in total, as well as safety problems such as the occurrence of socalled "hot spots", can result in pipe ruptures.

Although it is indicated in DE 26 51 253 Al that the pre-heater heated with outside heat can be significantly reduced in size or possibly even eliminated entirely, what is provided instead is that a distillate fraction to be passed back into the charge product is heated again in a heat exchanger heated by outside heat. The additional heating of the distillates reportedly results in a significantly reduced tendency towards coking, as compared with heating of the coal slurry.

SUMMARY OF THE INVENTION

Accordingly, one object of the invention is to structure the entire heat control of the process, with recovery of the reaction heat, by means of process technology, in such a way that the externally heated charge product furnace for heating the charge stream can be eliminated.

This and other objects which will become apparent from the following specification have been accomplished with the present process in which the hot separator head product gives its heat energy to the charge stream in separate indirect heat exchangers, and that the necessary temperature at entry into the liquid phase reactor is achieved by further heating the secondary partial stream of the hydrogenation gas in a hydrogenation gas heater and subsequently combining the secondary stream with the charge stream heated by the indirect heat exchange.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENTS

Figure 1:
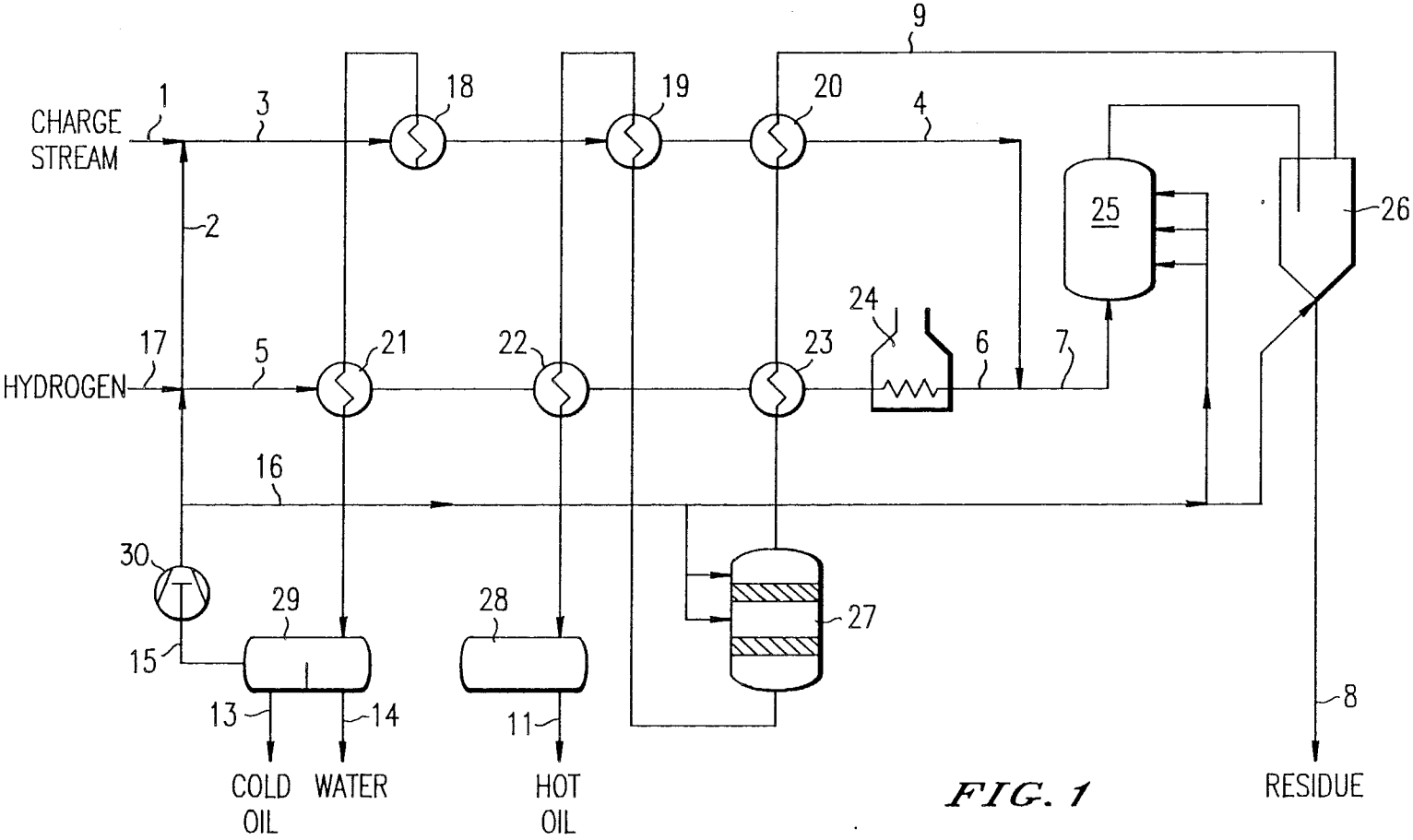
FIG. 1 shows a schematic diagram of the process of the present invention.

Broadly described, the present process is directed to the hydrogenation of a liquid hydrocarbon-containing charge material in a high temperature, high pressure liquid phase hydrogenation reactor. The hydrogenation reactor is supplied with two separately and indirectly heated charge streams which are combined prior to entry into the liquid phase hydrogenation reactor. The two charge streams comprise a primary charge stream which contains a liquid hydrocarbon, optionally mixed with ground coal, and hydrogenation gas, and a secondary gaseous charge stream which comprises a portion of the hydrogen-gas required by the liquid phase hydrogenation reactor. Both the primary charge stream and the secondary gaseous charge stream are separately and indirectly pre-heated by means of a hot separator head product originating from a hot separator which follows the liquid phase hydrogenation reactor. One or more pairs of separate heat exchange means (heat exchangers) indirectly heat the primary and secondary charge streams. After indirect heating by the heat exchange means with the hot separator head product, the secondary gaseous charge stream is subsequently heated by means of a hydrogenation gas heater. The required temperature for the charge streams at the entry to the liquid phase reactor is achieved by combining the indirectly heated primary charge stream with the indirectly and heated secondary gaseous charge stream.

The present process is suitable for processing liquid hydrocarbon charge materials which contain carbon and can be hydrogenated, such as heavy oils, oil residues (top and vacuum residue), syncrudes, e.g., from oil shale, tar sands, heavy oils, tars and pitches from hard coal or brown coal and similar substances.

Advantageously, however, in addition to the heavy oils or residues containing heavy mineral oils, mixtures of finely ground coal and the charge materials of the primary charge streams may be used in the present process, as so-called outside oils (coprocessing). This method has the advantage that the recycling streams required in coal hydrogenation for mashing the finely ground coal are extensively or completely eliminated. Weight ratios of coal and outside oil between 1:5 and 4:5 are preferred. Coal to be used includes all types which can be economically hydrogenated, for example, typical gas flame coals of the Ruhr area of West Germany.

In the present process, the greatest possible recovery of the heat energy of the reaction product is achieved, such that a hydrogenation gas heater for the separate partial stream of the hydrogenation gas (secondary charge stream) is sufficient to yield the starting temperature required for the liquid phase hydrogenation reaction at entry into the hydrogenation reactor and to equalize heat losses. It was only possible to achieve this result through the present discovery regarding the way in which the reaction products and the charge products are passed counter-current in the process. It is surprising that it is possible to introduce the heat energy which must be added into the process via a partial stream of the hydrogenation gas, without outside heating of the liquid or solid-liquid charge products.

As hydrogenation gas heaters, also referred to as hydrogenation gas furnaces, circulation furnaces, but preferably also radiation furnaces, may be used in which heating to a temperature of about 300° to 650° C., preferably about 490° to 550° C., takes place.

In a preferred embodiment of the present process (see FIG. 1), the charge stream (3) is passed through three heat exchangers (18, 19, 20), and the separately heated hydrogenation gas stream (5) is passed through three heat exchangers (21, 22, 23), counter-current to the hot separator head product. The gas stream (5) is indirectly heated before entry into the hydrogenation gas furnace (24).

The total hydrogenation gas amount required is divided between the two charge streams (3) and (5). If desired, fresh hydrogen can be provided as the feed for the primary charge stream, and circulating hydrogenation gas provided for the secondary partial stream of the hydrogenation gas.

In this regard, stream (9) enters into a heat exchange relationship consecutively with the primary charge stream (3), in heat exchanger (20), and with the secondary partial stream of the hydrogenation gas (5), in heat exchanger (23), and then passes through reactor (27) for hydrogenation in the gas phase, over a solid contact bed. The product stream refined in the reactor (27) passes through heat exchanger (19) and heat exchanger (22) as stream (10), entering a heat exchange relationship with stream (3) and stream (5) respectively, and through an intermediate separator (28), with separation of a hot oil fraction (11). The remaining stream (12) taken from the separator (28) gives its remaining heat, which can be utilized for heating the charge products, to stream (3) and stream (5) in the heat exchangers (18) and (21), and is passed to a cold separator (29), in which separation of waste water and waste gas occurs, as well as recovery of a cold oil fraction (13). Return of the circulating hydrogenation segment into the process takes place as stream (15), via compressor (30).

For temperature regulation in the liquid phase reactor (25) and in the hot separator (26), it is preferable to keep part of the circulating gas stream (16) available as a quench gas stream and to feed it in if necessary.

For the present process, temperatures in the liquid phase reactor of about 400° to 500° C. are typical, and the process pressure can be selected between about 150 to 1200 bar.

Subsequent to the cold separator (29), a gas scrubber can be provided, in usual manner (see U.S. Pat. No. 4,639,310, column 5, lines 4–18, for example), for treatment of the circulating hydrogenation gas segment. With such treatment, a sufficient hydrogen partial pressure in the hydrogenation gas system is guaranteed, by removal of the $C_1$ to $C_4$ (lower hydrocarbon) components, which are soluble by means of a conventional scrubbing fluid in the gas scrubber.

The secondary partial charge stream may contain about 20 to 95, preferably about 40 to 80% of the total hydrogenation gas amount required in the liquid phase reactor.

The present process is explained in more detail below, on the basis of the schematic of the diagram (FIG. 1), with the reference symbols indicated.

The stream of charge substances (1) which consists of a suspension with a conventional additive or catalyst (see Canadian Pat. No. 544,673 and U.S. application Ser. No. 07/105,290 incorporated herein by reference, for example) is combined with a partial stream of the hydrogenation gas (2), composed of circulating hydrogenation gas, stream (15), via compressor (30) with feed of fresh hydrogen, stream (17), to form stream (3), and pre-heated to the conditions of stream (4) by means of indirect heat exchange in the heat exchange apparatuses (18), (19) and (20).

The separate hydrogenation gas stream (5) is also pre-heated by indirect heat exchange in the heat exchange apparatuses (21), (22) and (23), and heated to the necessary temperature in the hydrogenation gas heater (24). The required reactor entry temperature in reactor (25) is achieved for stream (7), by the mixture of stream (6) with the material stream (4).

In the reactor (25), or in a cascade of consecutive reactors, the desired products are formed, which are separated into a residue stream (8) and into a head stream (9) in the hot separator (26).

The head stream (9) is utilized for pre-heating, counter-current to the charge stream (3) and hydrogenation gas stream (5), in the aforementioned heat exchange apparatuses (18), (19), (20), (21), (22) and (23). The circuit shown in the FIG. provides an integrated gas phase reactor (27) for the purpose of refining and further removal, particularly of the hetero-atom components containing 0, S and N. Catalysts in the gas phase hydrogenation reactor include all commonly utilized gas phase hydrogenation catalysts, such as for example, the catalysts described in U.S. Pat. No. 4,629,550.

It is preferable to place the gas phase reactor (27) in the circuit between apparatus (23) and apparatus (19).

The products condensed in the heat exchangers due to removal of the heat are collected in intermediate separator (28) and cold separator (29). The condensates are passed out of the high-pressure circuit as hot oil (11) and cold oil (13). After removal of the hot oil, water can be injected, in order to prevent salt from collecting in the downstream heat exchangers.

The reaction water formed during the hydrogenation process is separated in the cold separator (29), if applicable with the injection water, and passed out of the high-pressure circuit as stream (14). It contains the hetero-atom compounds removed by refining, among other things, in the form of simple hydrogen compounds dissolved in the waste water, $H_2S$ and also, particularly $NH_3$.

Depending on the design of the heat exchangers and the arrangement of the intermediate separator, the temperature in the intermediate separator can be freely selected within a certain range.

The residual gas which goes over the head in the cold separator (29) is passed back with a circulation compressor (30), optionally after a portion is passed out. Cold gas is removed from the feed-back gas as stream (16), for temperature control of the reactors and the hot separator. The fresh hydrogen required for the reaction is added as stream (17). It can also be provided that stream (2) is added as the fresh hydrogen stream.

Obviously, numerous modifications and variations of the present invention are possible in light of the above teachings. It is therefore to be understood that within the scope of the appended claims, the invention may be practiced otherwise than as specifically described herein.

WHAT IS NEW AND DESIRED TO BE SECURED BY LETTERS PATENT OF THE UNITED STATES IS:

1. A process for the hydrogenation of a liquid hydrocarbon-containing charge material, comprising the steps of:

(i) supplying a high temperature, high pressure liquid phase hydrogenation reactor with two separately and indirectly heated charge streams, (a) a primary charge stream comprising a liquid hydrocarbon which can be hydrogenated and hydrogen-containing gas, and (b) a heated secondary gaseous charge stream comprising hydrogen-containing gas, and combining said indirectly heated primary charge stream and said indirectly and heated secondary charge stream prior to said liquid phase hydrogenation reactor, hydrogenating said combined streams to produce a hydrogenation product and separating the hydrogenation product in a hot separator to give a hot separator head product;

wherein said indirectly heated primary and secondary charge streams are heated by separate heat exchange means by heat exchange with said hot separator head product, and said secondary charge stream, after heating by heat exchange, is heated with a hydrogenation gas heater.

2. The process of claim 1, wherein said primary charge stream further comprises ground coal.

3. The process of claim 1, wherein said secondary charge stream is heated in the hydrogenation gas heater to a temperature of about 300°-650° C.

4. The process of claim 3, wherein said secondary charge stream is heated in said hydrogenation gas heater to a temperature of about 490°-550° C.

5. The process of claim 1, wherein said secondary gaseous charge stream comprises about 20-95% of the total hydrogen gas required by said liquid phase hydrogenation reactor.

6. The process of claim 5, wherein said secondary gaseous charge stream comprises about 40-80% of the total hydrogen gas required by said liquid phase hydrogenation reactor.

7. The process of claim 1, wherein said hot separator head product is passed to a gas phase hydrogenation reactor, said hot separator head product is hydrogenated therein, and the gas phase reactor product so produced is passed to one or more separators to separate the gas phase reactor product into liquid product oil and recycle hydrogen-containing gas.

8. The process of claim 7, wherein said recycle hydrogen-containing gas is recycled to said liquid phase hydrogenation reactor, said hot separator or said gas phase reactor as a quench gas stream, whereby the temperature of said liquid phase reactor, hot separator, or gas phase reactor are regulated.

9. The process of claim 7, wherein said gas phase reactor product is passed through one or more heat exchange means whereby said primary and secondary charge streams are heated by heat exchange with said gas phase reactor product.

10. The process of claim 7, wherein said gas phase reactor product is alternatingly passed through (a) separate indirect heat exchange means for heating said primary and secondary charge streams and (b) one or more separators to separate liquid product oil and recycle hydrogen-containing gas.

11. The process of claim 7, wherein said gas phase reactor product is passed through separate indirect heat exchange means for heating said primary and secondary charge streams, is then passed through an intermediate separator to remove hot product oil and to form an intermediate separator product stream, the intermediate separator product stream is passed through another pair of separate indirect heat exchange means for heating said primary and secondary charge streams and then passed to a cold separator, wherein cold oil, water and hydrogen-containing gas are separated.

12. The process of claim 11, wherein the hydrogen-containing recycle gas is passed through a gas scrubber to remove lower hydrocarbon components.

13. The process of claim 1, wherein said liquid phase hydrogenation reactor contains a hydrogenation catalyst.

* * * * *